US008061714B2

(12) United States Patent
Roemer et al.

(10) Patent No.: US 8,061,714 B2
(45) Date of Patent: Nov. 22, 2011

(54) GAMING MACHINE GAME INCLUDING A MATCHING GAME

(75) Inventors: Mickey Roemer, Las Vegas, NV (US); David B. Schultz, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 13/070,127

(22) Filed: Mar. 23, 2011

(65) Prior Publication Data

US 2011/0172014 A1 Jul. 14, 2011

Related U.S. Application Data

(62) Division of application No. 12/845,020, filed on Jul. 28, 2010, now Pat. No. 7,938,401, which is a division of application No. 11/306,788, filed on Jan. 11, 2006, now abandoned, which is a division of application No. 10/662,605, filed on Sep. 15, 2003, now Pat. No. 7,631,872.

(51) Int. Cl.
*A63F 9/08* (2006.01)

(52) U.S. Cl. ..... 273/273; 273/274

(58) Field of Classification Search ..... 273/273, 273/274, 292; 463/9, 11
See application file for complete search history.

(56) References Cited

U.S. PATENT DOCUMENTS

| | | | | |
|---|---|---|---|---|
| 5,882,258 | A * | 3/1999 | Kelly et al. | 463/11 |
| 6,131,909 | A * | 10/2000 | Chilese | 273/292 |
| 2003/0100356 | A1 * | 5/2003 | Brown et al. | 463/9 |
| 2004/0082376 | A1 * | 4/2004 | Baerlocher et al. | 463/16 |
| 2004/0166929 | A1 * | 8/2004 | Tarantino | 463/22 |

OTHER PUBLICATIONS

Heins Palm Page, SAMEGAME, http:||www.geoci-Jes.com|ResearchTriangle|System127711Pilot|palmpage.html, Mar. 1999.*

Monte Carlo, "Hoyle's Modern Encyclopedia of Card Games", by Walter B. Gibson, (New York, Doubleday & Co.), 1974, pp. 343, 344.*

* cited by examiner

*Primary Examiner* — William Pierce
(74) *Attorney, Agent, or Firm* — Marvin A. Hein

(57) ABSTRACT

Disclosed is a gaming machine that displays a plurality of indicia-bearing game pieces 12 on a gaming grid 14. A player then selects game pieces 12 that are adjacent and that have matching indicia 16. Preferably, the matching adjacent game pieces 34 that are selected are then removed from the gaming grid 14. One or more prizes are awarded in association with the selection and removal of the matching adjacent game pieces 34. Preferably, the player is also provided with the ability to shuffle any remaining non-selected game pieces 32, after all matching adjacent game pieces that are perceived by the player are selected and removed. In this regard, it is possible that the player may overlook some matching adjacent game pieces 34. Additionally, some preferred embodiment gaming machines incorporate the use of multiple indicia 16 on each game piece 12 for potentially matching with adjacent game pieces. Finally, awards can be awarded to a player based upon game speed and the number of shuffles required to clear the grid 14, amongst other criteria. Preferably, the gaming machine also includes activation of an interactive help feature 100 for the bonus game. The help feature 100 is continuously accessible, allowing access to the help feature during play of the bonus game so that a player unfamiliar with the bonus game may receive instructions on how to play the bonus game during play of an active bonus game.

12 Claims, 10 Drawing Sheets

GAMING MACHINE GAME INCLUDING A MATCHING GAME

CROSS-REFERENCE TO RELATED APPLICATIONS

This application is a continuation of U.S. application Ser. No. 12/845,020 filed on Jul. 28, 2010, which is a divisional of U.S. application Ser . No. 11/306,788 filed on Jan. 11, 2006, now abandoned, which is a divisional of U.S. application Ser. No. 10/662,605 filed Sep. 15, 2003, now U.S. Pat. No. 7,631, 872, which are herein incorporated by reference in their entireties.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The present invention relates generally to gaming machines, and more particularly, to a gaming machine for playing a game involving the matching of symbols on a game screen.

2. Description of the Related Art

As the gaming industry has expanded over the years, numerous types and variations of gaming machines have been developed for the enticement and enjoyment of players. Game play is enticed with the possibility of one or more payout awards to the player. Also, some games involve elements of both skill and chance. To many players, the popularity of a game is connected with the perception of how often a game pays out awards. In this regard, the possibilities for devising different types of awards are seemingly as endless as the variations of games and gaming machines.

Some games that players enjoy involve elements of both chance and skill. One such traditional game of chance and skill is a matching game. In a traditional matching game, players select and "match" symbols that are exhibited on cards or tiles displayed to the player. Matching games may be played as a table game using cards, on a mechanical gaming machine or video gaming machine using cards, or as tiles located within a grid. Typically, play of a matching game begins with the display of a plurality of cards or tiles, each of the cards or tiles exhibiting a symbol. In some matching games, the cards or tiles are displayed face down and the player must remember where the symbols are located and turn them face up in order to match the cards or tiles. In other matching games, the cards or tiles are displayed face up. The object of this type of game is to match all of the cards or tiles and to clear the screen as quickly as possible. Still in other matching games, some cards or tiles are displayed face up while others are displayed face down.

For most traditional matching games, the goal of the game is to have the player select the symbols and "match" two or more identical symbols. The matched cards or tiles are removed from play, and the player continues to match cards or tiles until all of the cards or tiles have been matched together. When the cards or tiles are matched, the player receives an award corresponding to his play of the game.

However, none of the matching games in the prior art allow or require a player to match files or cards based upon both similar symbols as well as the location of the files with respect to one another. Accordingly, there is a continuing need in the art to provide unique and interesting methods of playing a matching game and for providing awards for the matching of symbols appearing on a plurality of tiles within a grid.

Additionally, as the gaming options become more numerous and complex, players can sometimes have difficulty keeping up with the knowledge required to play these games. If a player is losing while playing new or more complex games because of a lack of knowledge of game rules, this will tend to decrease player interest and excitement. This can be particularly true with respect to new or more complex bonus games that may be more unique, or to which the player may have more limited exposure. Accordingly, there is a continuing need in the art to provide new devices and methods for imparting helpful knowledge to players as to how new and/or more complex games are played, preferably with little or no detrimental effect to player excitement during this learning process.

SUMMARY OF THE INVENTION

Briefly, and in general terms, the present invention provides a gaming machine for playing a game that involves matching adjacent game pieces, each game piece displaying the same indicia. The gaming machine is enabled to display a plurality of indicia-bearing game pieces on a gaming grid; allow selecting game pieces that are adjacent and that have matching indicia; remove the matching adjacent game pieces that were selected from the gaming grid; and award at least one prize associated with the selection and removal of the matching adjacent game pieces.

More particularly, in accordance with one aspect of the present invention, the selection and removal of the matching adjacent game pieces proceeds one pair of matching adjacent game pieces at a time. However, in other embodiments, matching adjacent game pieces are selected in groups larger than one pair at a time. Preferably, the selection and removal of the matching adjacent game pieces proceeds until all matching adjacent game pieces (or all matching adjacent game pieces that are perceived by a player) are removed from play, and any prizes associated therewith have been awarded.

In accordance with another aspect of the present invention, adjacent game pieces are defined as game pieces that touch along a vertical edge, a horizontal edge, or a diagonal corner. In one embodiment of the present invention, each game piece contains only a single indicium that is used to potentially match with the indicia of adjacent game pieces. Furthermore, in one embodiment of this gaming method, the indicium displayed on each game piece that is used to match with the indicia of adjacent game pieces corresponds to the prize to be awarded. In another aspect of the present invention, the prize to be awarded is a non-monetary prize. In one such embodiment, the prize to be awarded is a magazine photograph. Specifically, in one exemplary embodiment, the magazine photograph is a cover, such as a Playboy Playmate.

In accordance with another aspect of the present invention, one or more "sets" of indicia are used. These indicia or pictures can include various denominations of currency, traditional gaming machine symbol sets or sets, of "themed" symbols. In embodiments that utilize currency symbols, the denominations of currency (i.e., cents, dollars, and the like) may be selected, as well as the actual type of currency shown (i.e., U.S. dollars, English pounds, and the like). Themes of symbols also may be selected, such as a circus theme showing symbols of clowns, unicycles, elephants, lions, and the like. Pictures, or sets of pictures may also be used, such as, but not limited to, Playboy Playmate themed tiles or sports figure themed tiles. Finally, the more traditional gaming symbols may be used on the tiles, such as card suits, sevens, bars, and fruit.

In accordance with another aspect of the present invention, each game piece displays a plurality of indicia that are used to potentially match with at least one of the plurality of indicia of the adjacent game pieces. Preferably, each game piece contains three indicia that are used to potentially match with at least one of the three indicia of an adjacent game piece. In one particular embodiment, the three indicia of the game pieces include, by way of example only, and not by way of limitation, game piece color, type of indicia, and color of indicia. Other non-limiting examples of indicia characteristics include game piece shape, indicia shape, and indicia size.

In accordance with yet another aspect of the present invention, the game pieces are video representations of game pieces. Furthermore, in one embodiment the game pieces are selected using touch screen technology. Specifically, in one exemplary embodiment the game pieces are tiles. However, the game pieces may also be cards, blocks, or other similar objects that are displayed within the gaming grid. Preferably, the video simulation of the tiles, which are arranged within or on a gaming grid, is implemented on a video gaming machine. In other embodiments, the method for playing a game incorporates the use of selection buttons. Such selection mechanisms may include, but are not limited to, buttons corresponding to the grid tiles on the display, which can be activated to select a given tile, or various scrolling mechanisms, which permit a player to scroll up and down and left to right to highlight and then select certain grid tiles or game pieces.

In accordance with still another aspect of the present invention, the gaming method further includes shuffling any non-selected game pieces remaining within the game grid into a consolidated grouping, after all matching adjacent game pieces that have been perceived by a player have been selected and removed. This provides a player with a supplemental opportunity to select and remove any additional matching adjacent game pieces. In one embodiment, the shuffling of any remaining game pieces and the selecting of matching adjacent game pieces is repeatable up to a predetermined maximum number of times. Preferably, the shuffling of any remaining game pieces and the selecting of matching adjacent game pieces is repeatable up to three times.

In accordance with another aspect of the present invention, one or more prizes are awarded in connection with the following criteria, which are provided by way of example only, and not by way of limitation: the total number of matches made, the indicia shown on the game pieces that are matched, the indicia shown on game pieces that are matched last, the indicia shown on game pieces that are not matched, the speed with which the game pieces are matched, the number of shuffles required to match all game pieces, the matching of all game pieces, and various combinations thereof. In one embodiment of the present invention, the method for playing a game is at least partially skill-based, while in other embodiments, the method has only the appearance of being skill-based.

Additionally, in another method for playing a game that involves matching adjacent game pieces, each game piece displaying the same indicia, the method includes: displaying a plurality of indicia-bearing game pieces on a gaming grid; selecting game pieces that are adjacent and that have matching indicia; deactivating the matching adjacent game pieces that were selected; and awarding at least one prize associated with the selection and deactivation of the matching adjacent game pieces. In such an embodiment, the deactivation of the matching adjacent game pieces that are selected does not necessarily result in the removal of those game pieces from the gaming grid. In this way, for example, the game pieces may be used in subsequent games upon reshuffling of the game pieces.

In accordance with another aspect of the present invention, a video gaming machine that displays a primary game and a secondary game, also provides information to assist a player in how to play a game while a game is in active play. Preferably, the gaming machine includes a video screen, a microprocessor, and an interactive help feature. The video screen displays game play and the microprocessor controls at least a portion of the game play. Preferably, the interactive help feature provides game rules and related information for the secondary game. In other embodiments, the interactive help feature provides game rules and related information for the primary game in addition to and/or instead of the secondary game. In a preferred embodiment of the present invention, the help feature is continuously accessible, allowing access to the help feature at any time during play of the secondary game. Thus, if a player is unfamiliar with the secondary game, the player may receive instructions on how to play the secondary game while that secondary game is currently active.

In accordance with another aspect of the present invention, the interactive help feature preferably includes multiple help screens. In one preferred embodiment, the interactive help feature includes navigation controls to assist a player in moving between the multiple help screens. In accordance with another preferred aspect of the present invention, the interactive help feature includes both static and animated assets that provide explanations of game play. Preferably, the animated assets in the interactive help feature provide real time examples of game play. In still another preferred embodiment, the animated assets in the interactive help feature allow a player to participate in at least a portion of a sample bonus game.

In accordance with still another aspect of the present invention, the interactive help feature incorporates touch screen controls. Preferably, the interactive help feature is exitable by a player at any time. In one preferred embodiment, the interactive help feature occupies only part of the video screen, while in another preferred embodiment the interactive help feature occupies all of the video screen. In accordance with yet another aspect of the present invention, the interactive help feature halts play of the bonus game while the interactive help feature is activated. Alternatively, in another preferred embodiment, the interactive help feature does not affect play of the bonus game when the interactive help feature is activated.

Another embodiment of the present invention is directed towards an interactive help system for a video gaming machine, the gaming machine displaying an initial game and a bonus game. Preferably, the interactive help system provides information that allows a player to learn game rules during play of an active game. In a preferred embodiment, the help system includes a video screen that displays at least a portion of the help system when activated, a microprocessor that controls at least a portion of the help system, and an interactive help feature for the bonus game. Preferably, the help feature is continuously accessible, allowing access to the help feature at any time during play of the bonus game. In this manner, a player unfamiliar with the bonus game may receive instructions on how to play the bonus game during an active bonus game.

Another embodiment of the present invention is directed towards a method for playing a gaming machine that incorporates an interactive bonus game help feature. The method includes initiating play of a primary game; initiating play of a bonus game in response to a predetermined outcome of the primary game; in response to a selection event by a player, activating an interactive help feature for the bonus game during play of the bonus game, wherein the help feature is available on demand by the player, and wherein the help feature is initiatable at any time during play of the bonus game so that a player may receive instructions that assist in proper play of the bonus game while the bonus game is in active use; and resuming play of the bonus game after the use of the help feature is completed.

Other features and advantages of the present invention will become apparent from the following detailed description, taken in conjunction with the accompanying drawings, which illustrate by way of example, the features of the present invention.

DETAILED DESCRIPTION OF THE EMBODIMENTS

A preferred embodiment gaming method, implemented in accordance with the present invention, provides a player with the opportunity to play a matching game in which a plurality of indicia-bearing game pieces are displayed on a gaming grid or game screen. Such a game can be a primary game or a secondary bonus game. In this manner, player excitement is derived and heightened from the visual entertainment that occurs when matching adjacent game pieces are selected and removed from the gaming grid in an attempt by the player to clear all game pieces from the gaming grid to receive prizes in association therewith.

Figure 1:
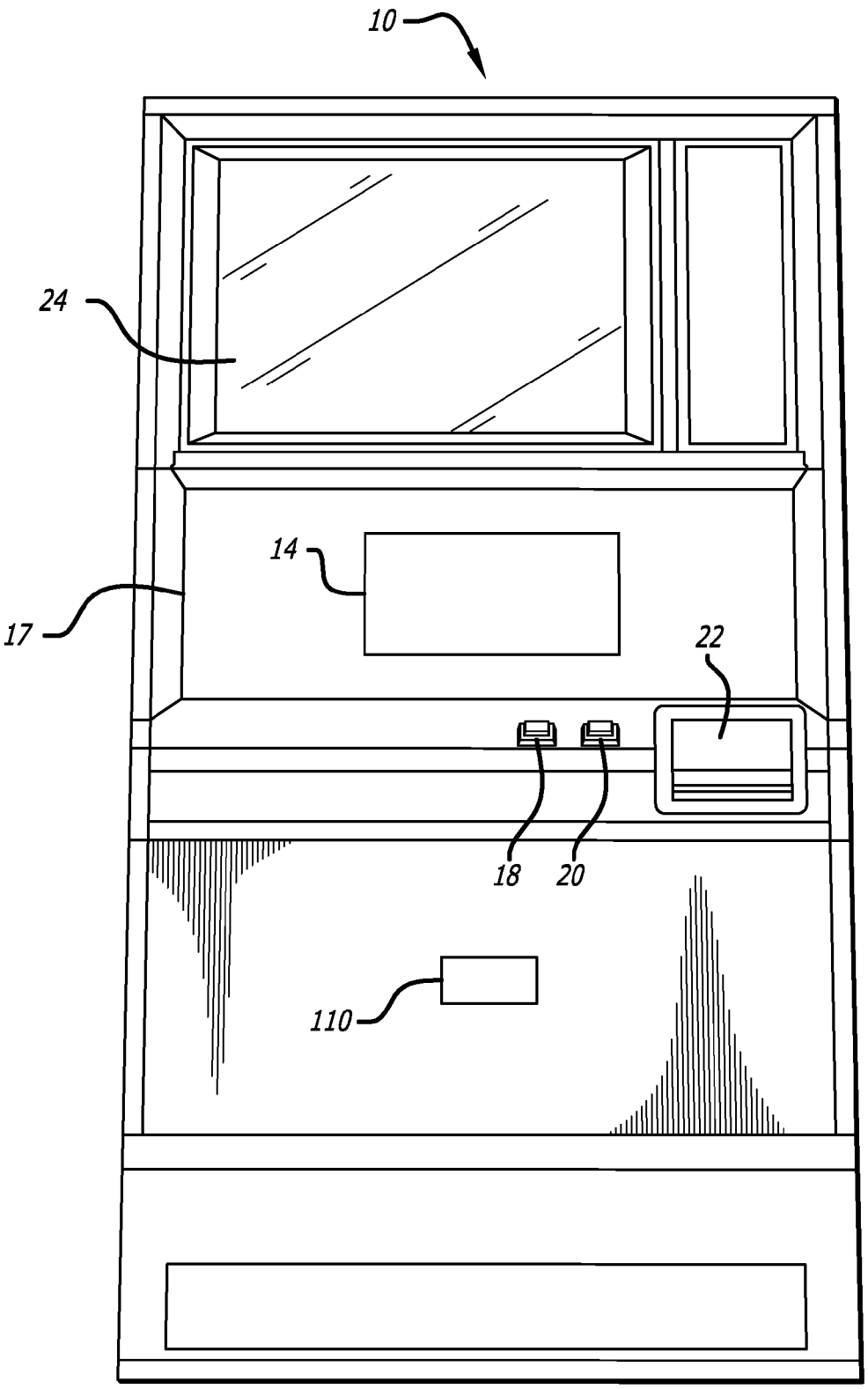
FIG. 1 is a schematic illustrating a typical gaming machine for use, in accordance with the present invention, showing symbols displayed on game pieces or tiles located on a gaming grid.
Figure 2:
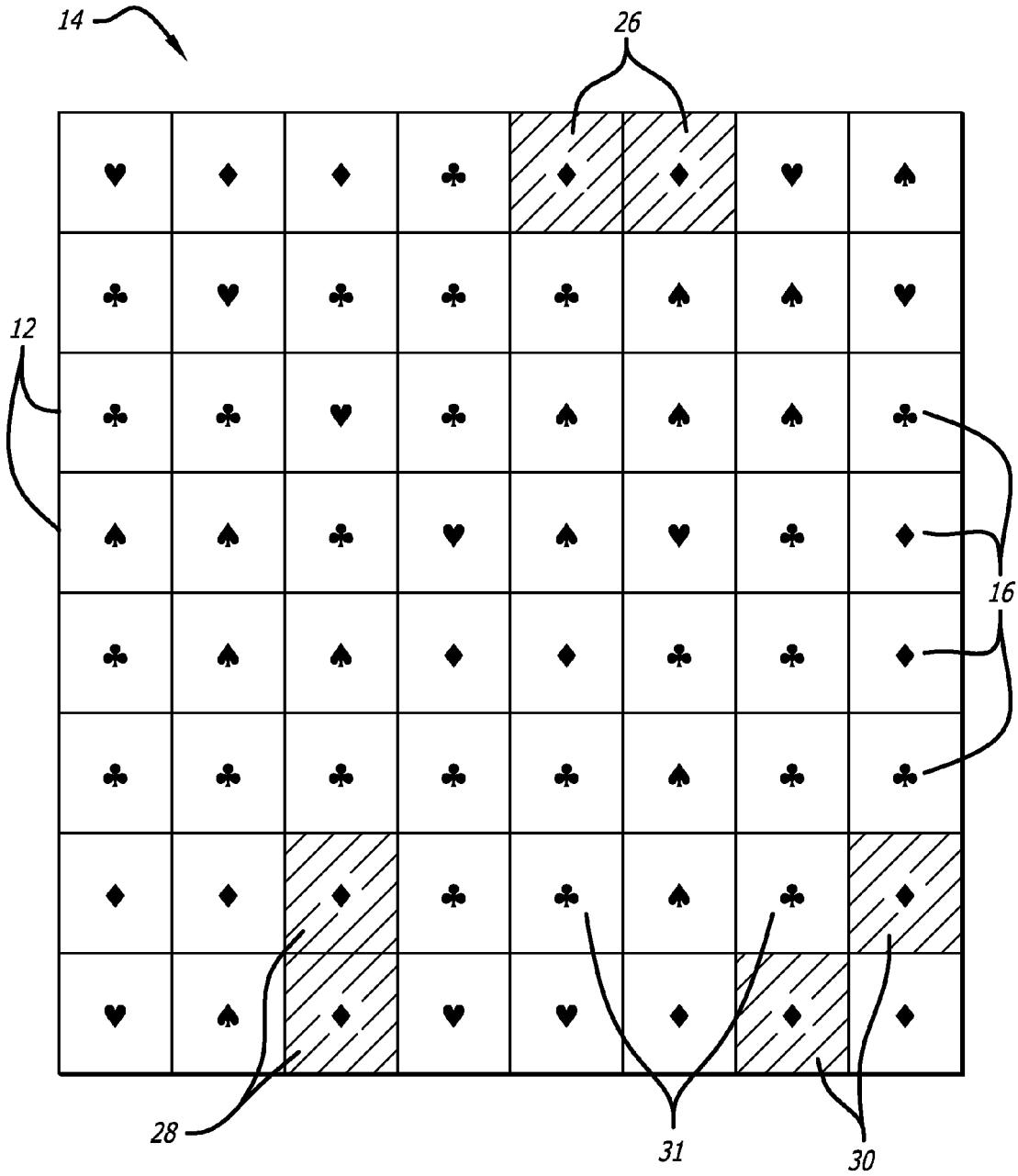
FIG. 2 is a schematic illustrating a gaming grid on which game pieces are positioned, the game pieces exhibiting card suit symbols thereon, and further illustrating the concept of matching adjacent game pieces.

Referring now to the drawings, wherein like reference numerals denote like or corresponding parts throughout the drawings, and more particularly to FIGS. 1-2, there is shown a preferred method for playing a matching game, in accordance with the present invention. Briefly stated, a preferred embodiment method of the present invention utilizes a gaming machine 10 having game pieces 12 positioned contiguously on a gaming grid 14 or screen. Each game piece 12 displays indicia 16 that may or may not match the indicia of adjacent game pieces. A preferred method includes displaying a plurality of indicia-bearing game pieces 12 on the gaming grid 14. A player then selects game pieces 12 that are adjacent and that have matching indicia 14. Preferably, the matching adjacent game pieces 12 are selected and then removed from the gaming grid 14. One or more prizes are awarded in association with the selection and removal of the matching adjacent game pieces 12. Preferably, the player is also provided with the ability to shuffle any remaining non-selected game pieces 12, after all matching adjacent game pieces (or all matching adjacent game pieces that have been perceived by the player) have been selected and removed in the current round of play. In this regard, it is possible that the player may overlook some matching adjacent game pieces 12. Preferably, it is in the player's best interest to identify and select all of the matching adjacent game pieces 12. Additionally, some preferred embodiment gaming methods incorporate the use of multiple indicia 16 (or categories of indicia 16) on each game piece 12 for potentially matching with adjacent game pieces.

FIG. 1 illustrates a preferred embodiment gaming machine 10, configured with a display screen 17 on which the gaming grid 14 and game pieces 12 are displayed. As described above, each of the game pieces 12 displayed on the gaming grid 14, include at least one indicium 16 (e.g., symbol). The size of the gaming grid 14 and the number of game pieces 12 used on the gaming grid may differ between various preferred embodiments of the present invention. In one embodiment, the gaming machine 10 further includes control buttons, such as, but not limited to, (1) betting buttons 18, for adding and/or modifying any bets a player makes on the outcome of a game, and (2) a play/shuffle button 20 that is used to initiate the play of the game and to shuffle the game pieces 12 on the grid 14. Additionally, in a preferred embodiment, the gaming machine 10 is also configured with a coin-in slot 22 and a secondary display/top box 24.

In some preferred embodiments of the present invention, the gaming machine is a video gaming machine. In one embodiment, the control buttons (e.g., the betting button 18 and the shuffle button 20) are provided on a touch screen. Thus, in such an embodiment, the gaming machine display screen 17 is a touch sensitive screen. The player is able to select game pieces 12 on the grid 14 by merely touching the grid locations on the screen 17 that correspond to the game pieces that the player wishes to select.

In other preferred embodiments, the control buttons are hard-wired to the gaming machine 10 for use by the player in controlling various functions of the matching game. However, in other preferred embodiments, the selection of the game pieces 12 on the grid 14 is accomplished using buttons that correspond directly to the game pieces on the grid. In still additional embodiments, scrolling mechanisms are used to scroll up, down, left, and right, and then to highlight or otherwise select game pieces 12 on the grid 14. Other mechanical and/or electro-mechanical selection devices may also be used in other embodiments of the present invention. Furthermore, additional buttons may be added to the gaming machine 10 to further facilitate control of the game.

As shown in FIG. 2, in a preferred embodiment, a player locates and selects two game pieces 12 that are positioned next to one another on the grid 14 and that have matching indicia 16 displayed thereon. FIG. 2 illustrates various ways that game pieces 12 may be positionally located so as to be considered adjacent to each other. Preferably, game pieces 12 may be horizontally adjacent 26, vertically adjacent 28, or diagonally adjacent 30. In a preferred embodiment, game pieces 12 are defined as adjacent when they are directly next to, i.e. "touching" another game piece 12. In such an embodiment, game pieces 12 that have the same indicia 16 thereon and are in close proximity to each other, but are not touching, are considered non-matching adjacent game pieces 31. In one preferred embodiment, after a pair of matching adjacent game pieces have been selected by the player, the selected game pieces disappear or are otherwise removed from the gaming grid 14. In another preferred embodiment, matching adjacent game pieces that are selected by the player are simply deactivated, such that the game pieces cannot be selected again.

Figure 3:
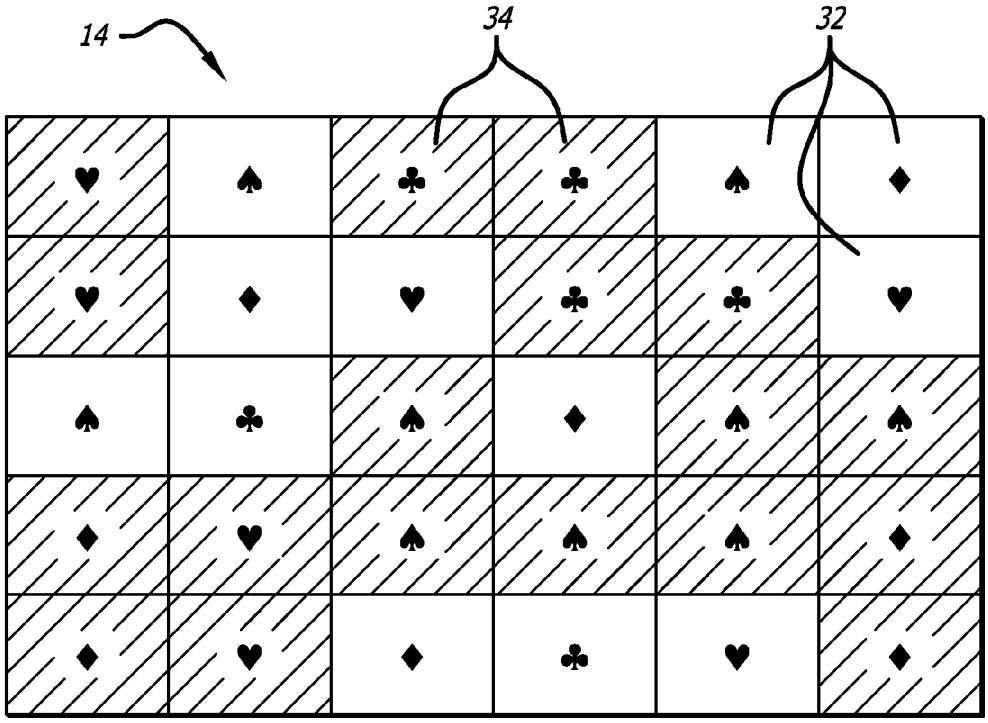
FIG. 3 is an exemplary display of one embodiment, according to the present invention, showing a gaming grid wherein matching adjacent game pieces are selected in a first selection period.

In the preferred embodiment shown in FIG. 3, the gaming grid 14 and game pieces 12 are initially displayed to a player on a gaming machine 10. The player attempts to select all of the matching adjacent game pieces that are displayed. It is possible that a player may overlook, and thus, not select some of the matching adjacent game pieces. In FIG. 3, exemplary matching adjacent game pieces 34 (hereinafter matching adjacent game pieces are numerically designated as 34) are highlighted. Correspondingly, exemplary non-selected game pieces 32 (hereinafter non-selected game pieces are numerically designated as 32) are not highlighted. During play, the player attempts to select all of the matching adjacent game pieces 34 that are displayed on the grid 14. However, as discussed above, the player may miss or otherwise overlook some of the matching adjacent game pieces 34, and therefore, select only a portion of the matching adjacent game pieces 34 displayed on the gaming grid 14. In either circumstance, the player reaches a point of play where he believes that no further matching adjacent game pieces 34 remain on the grid 14. Thus, these non-selected game pieces 32 that remain on the grid 14 are either non-matching adjacent game pieces or missed matching adjacent game pieces. Preferably, it is in the player's interest not to miss any matching adjacent gaming pieces 34.

In one preferred embodiment, after the player has selected all of the matching adjacent game pieces 34 (or all of the matching adjacent game pieces 34 that he perceives to be on the grid 14), and those matching adjacent game pieces that were selected have been removed, the player is provided with the option of shuffling the remaining game pieces (i.e., the non-selected game pieces 32) on the grid 14. The shuffling process consolidates the remaining game pieces into a consolidated, contiguous arrangement that creates new adjacent game piece positions. In other words, by shuffling the non-selected game pieces 32, additional matching adjacent pairs of game pieces may be produced.

Figure 4:
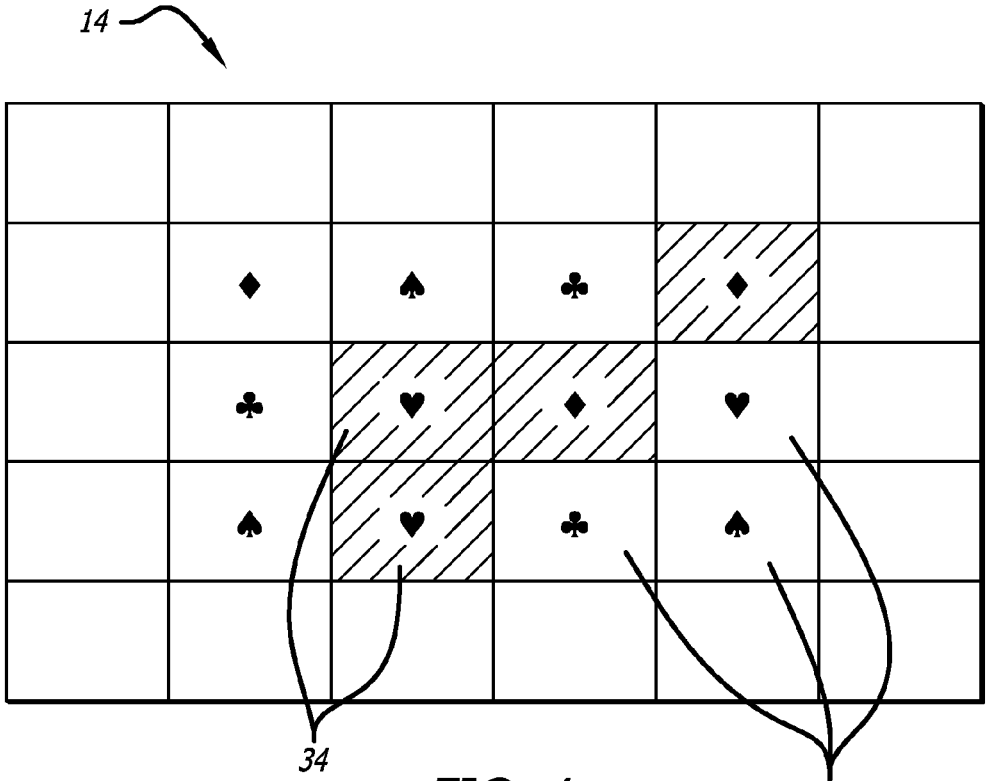
FIG. 4 is an exemplary display of one embodiment in a second selection period, according to the present invention, after the selection and removal of matching adjacent game pieces in FIG. 3, and after the shuffling and consolidating of the non-selected game pieces from the first selection period.

In the embodiment shown in FIG. 4, all of the matching adjacent game pieces 34 that were selected (from FIG. 3) have been removed from the grid 14, and the remaining non-selected game pieces 32 have been shuffled. Thus, the only game pieces 12 that remain on the gaming grid 14, as shown in FIG. 4, are the non-selected game pieces 32 from FIG. 3. As discussed above, the shuffling process arranges the remaining game pieces 12 into a consolidated grouping located within the grid 14. The shuffling process creates new adjacencies among the remaining game pieces, thereby potentially creating new matching adjacent game pieces 34. Following the shuffle, the player selects all of the matching adjacent game pieces 34 (or all of the matching adjacent game pieces 34 that the player perceives) on the gaming grid 14 that are produced by the shuffle in this second selection period. Again, the player may overlook, and thus, not select some of the matching adjacent game pieces 34 in the second selection period. Thus, the game pieces 12 shown in FIG. 4 that are not matching adjacent game pieces (and any overlooked matching adjacent game pieces) remain non-selected game pieces 32 at the end of the second selection period.

Figure 5:
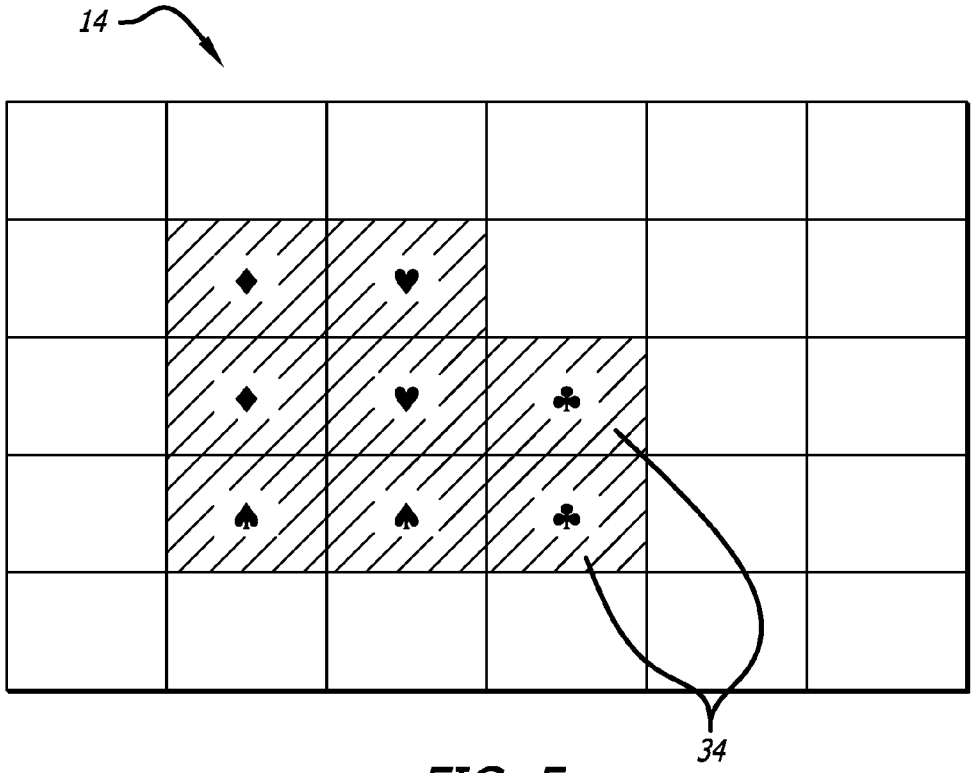
FIG. 5 is an exemplary display of one embodiment in a third selection period, according to the present invention, after the selection and removal of matching adjacent game pieces in FIG. 4, and after the shuffling and consolidating of the non-selected game pieces from the second selection period, and further showing a scenario whereby all remaining game pieces are cleared from the gaming grid.

In the game outcome shown in FIG. 5, the non-selected game pieces 32 from the consolidated grouping in the second selection period are shuffled into another consolidated grouping for the third selection period. In the resultant grouping of game pieces 12 shown in FIG. 5, the player is able to select all of the remaining game pieces as matching adjacent game pieces 34 in this third selection period, and thus, clear the gaming grid 14 when these matching adjacent game pieces 34 are selected and removed. Previously, the game pieces 12 selected during the first selection period were removed from the grid 14, as were the game pieces selected during the second selection period. Therefore, FIG. 5 shows a game outcome in which a player succeeds in clearing the grid 14 by matching all of the game pieces 12 during the third selection period.

Figure 6:
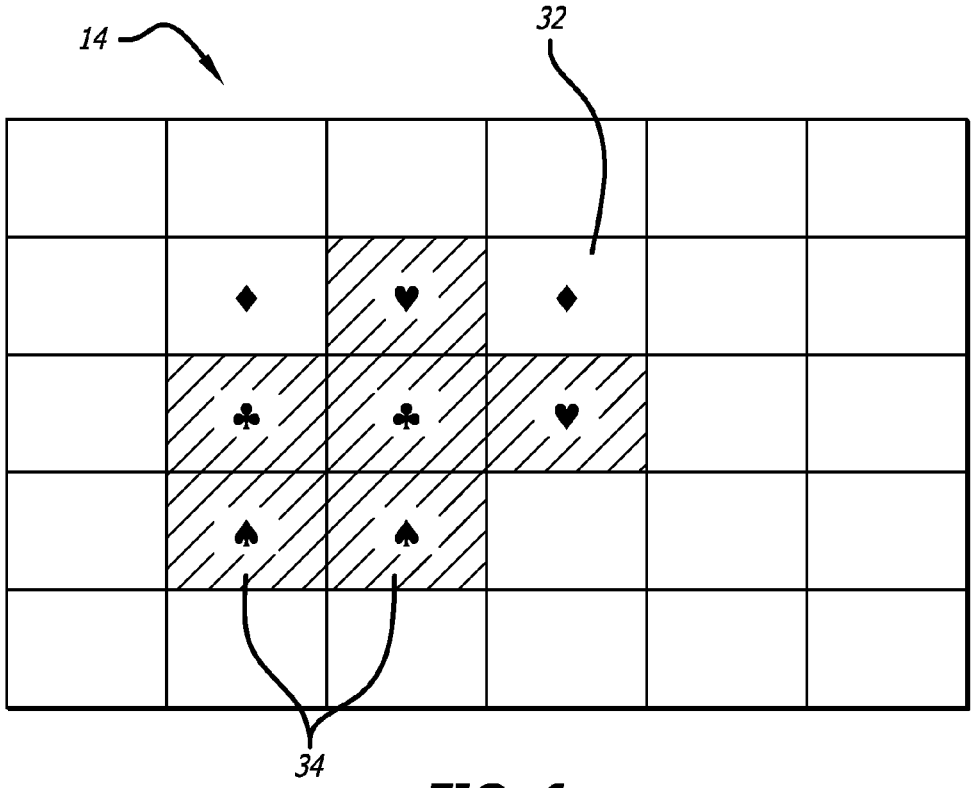
FIG. 6 is another exemplary display of one embodiment in a third selection period, according to the present invention, after the selection and removal of matching adjacent game pieces in FIG. 4, and after the shuffling and consolidating of the non-selected game pieces from the second selection period, and further showing a scenario whereby all remaining game pieces are not cleared from the gaming grid.

Conversely, FIG. 6 illustrates an alternate game outcome to FIG. 5 (i.e., a different post-shuffle configuration of the remaining game pieces). In FIG. 5, a player succeeds in clearing the grid 14 by matching all of the game pieces during the third selection period. In the game outcome shown in FIG. 6, however, the non-selected game pieces 32 from the grid 14 are shuffled into a consolidated grouping that does not provide the player with an opportunity to select all of the remaining game pieces as matching adjacent game pieces 34. In the game scenario of FIG. 6, the player cannot select all of the game pieces 12 from the grid 14 in the third selection period due to their random placement as non-matching adjacent game pieces after the consolidation of the second shuffle. Therefore, FIG. 6 illustrates a situation where the player is left with non-selected game pieces 32 remaining on the grid 14. Thus, the player does not succeed in clearing the grid 14 of all game pieces 12 in the third selection period. In a preferred embodiment of the present invention that allows up to three shuffles, the player has one last shuffle, after which, the player can attempt, one more time, to clear the gaming grid 14 in the fourth selection period.

Preferably, a player has the option to shuffle the game pieces 12 three times after the gaming grid 14 is initially displayed, thus resulting in a total of four selection periods. In this regard, the player will have four attempts to clear all the game pieces from the grid 14. One of ordinary skill in the art will appreciate, however, that any number of selection periods and shuffles may be used in accordance with the present invention.

In summary, the process includes: (1) initially selecting and removing any matching adjacent game pieces 34 perceived by the player from amongst all game pieces initially displayed on the grid 14, thereby attempting to clear the grid; (2) shuffling any remaining, non-selected game pieces 32 to form a consolidated grouping that creates new adjacencies on the gaming grid; (3) again, selecting and removing any matching adjacent game pieces 34 produced from the consolidation of game pieces, thereby attempting to clear the grid; (4) shuffling, if any, the remaining, non-selected game pieces 32 a second time to again form a consolidated grouping that creates new adjacencies on the gaming grid 14; (5) selecting and removing any matching adjacent game pieces 34 produced from the second consolidation of game pieces, thereby attempting to clear the grid; (6) shuffling the remaining, if any, non-selected game pieces 32 a third time to form, yet again, consolidated a grouping that creates new adjacencies on the gaming grid 14; and (7) selecting and removing any matching adjacent game pieces 34 produced from the third consolidation of game pieces, thereby attempting to clear the grid. The player is then rewarded based upon the number of game pieces, matched, the number of shuffles required to clear the screen, speed of play, or the like, or any combination thereof.

Although in one preferred embodiment, the player has four attempts to clear the game pieces 12 from the grid 14 by shuffling remaining game pieces, in another embodiment of the matching game, a player is not permitted to shuffle the game pieces at all. In still another embodiment, a player is provided with more than three shuffles (and thus, four selection periods) to clear the grid 14. In another such embodiment, the player is given unlimited shuffling opportunities.

In one preferred embodiment, once the player has selected all of the matching adjacent game pieces 34 he perceives, an award is provided. The amount of the award may vary depending on the number of shuffles required by the player to clear the grid, e.g., a special bonus award may be awarded if the player clears the grid during the first selection period. The award may also vary according to the speed at which the player selects matching pairs. The award may further vary according to how many game pieces remain when no more shuffles are available. The award may also vary depending on the final pair selections or upon the initial selections made. In other embodiments, still additional factors of the game may be used to vary the award and game play.

Figure 7:
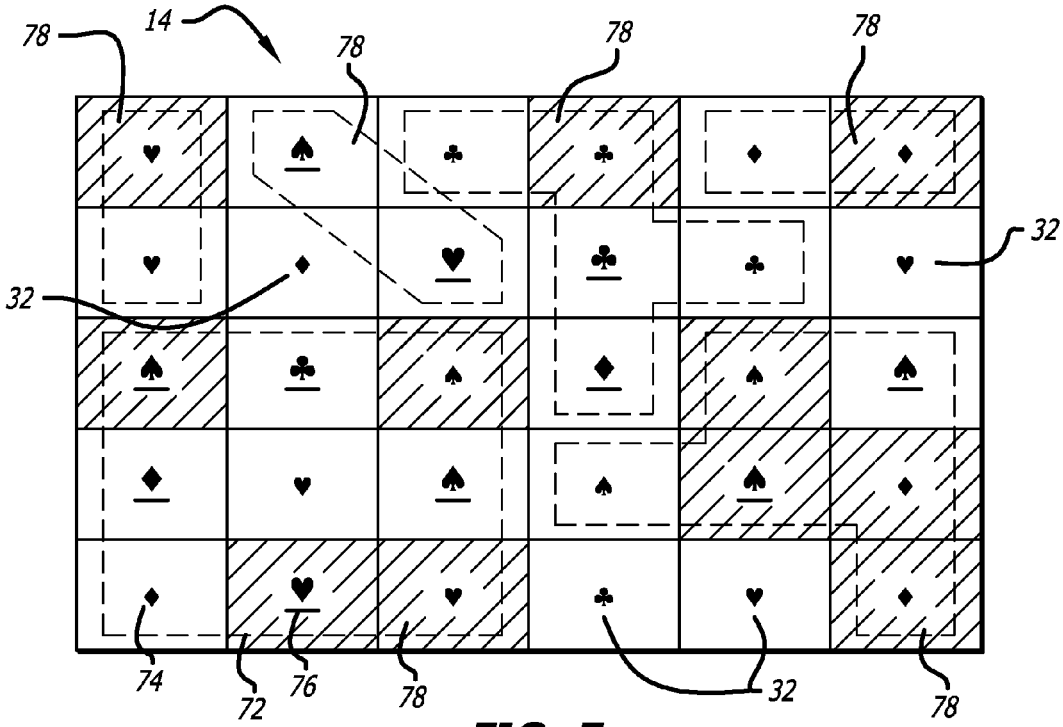
FIG. 7 is a schematic illustrating a grid comprised of game pieces exhibiting three potential matching elements (i.e. symbol shape, tile background color, and symbol size/color) and showing exemplary three-way matches.

In another embodiment of the matching game shown in FIG. 7, each game piece 12 includes three distinct categories of indicia 16. In this embodiment, a player matches adjacent game pieces 12 based upon at least one of three categories of indicia 16 exhibited on the game pieces 12. FIG. 7 illustrates the multiple different indicia 16 on the game pieces 12 used to "match" adjacent game pieces. By way of example only, and not by way of limitation, in one embodiment the categories of indicia 16 are represented by game piece color 72 (represented by shading on the background of some game pieces in FIG. 7), type of indicia 74, and color of indicia 76 (indicia color being represented by underlining in FIG. 7). In this regard, the player may "match" adjacent game pieces 12 according to the game piece's background color 72, type of indicia 74, and color of indicia 76.

Preferably, in this embodiment, the player selects a first game piece and continues to move from adjacent game piece to adjacent game piece, matching one or more categories of indicia 16 on the game pieces. Preferably, several game piece groups 78 are selected by matching at least one category of indicia 16 on a first game piece with an adjacent game piece. FIG. 7 also shows that this manner of matching one or more categories of indicia 16 for each game piece may still result in non-selected game pieces 32, and thus, the gaming grid 14 may not be completely cleared. As such, in some embodiments, the shuffle option may also be available here.

Because the player is matching one or more categories of indicia 16 for each game piece 12, the play of the game in this embodiment adds another dimension to the matching game, because each game piece has the potential to match with an increased number of adjacent game pieces. Moreover, in an embodiment where matching adjacent game pieces that are selected disappear from the grid, the skill factor is increased since the player must decide the order in which matching adjacent game pieces are selected. That is, the matching of adjacent game pieces in one indicia category may very well result other game pieces no longer having any matching adjacencies. In yet another embodiment, the complexity of the game may be altered by requiring more than one of the three categories of indicia 16 exhibited on the game pieces 12 to be matching in order for a pair of game pieces 12 to be selectable.

Figure 8:
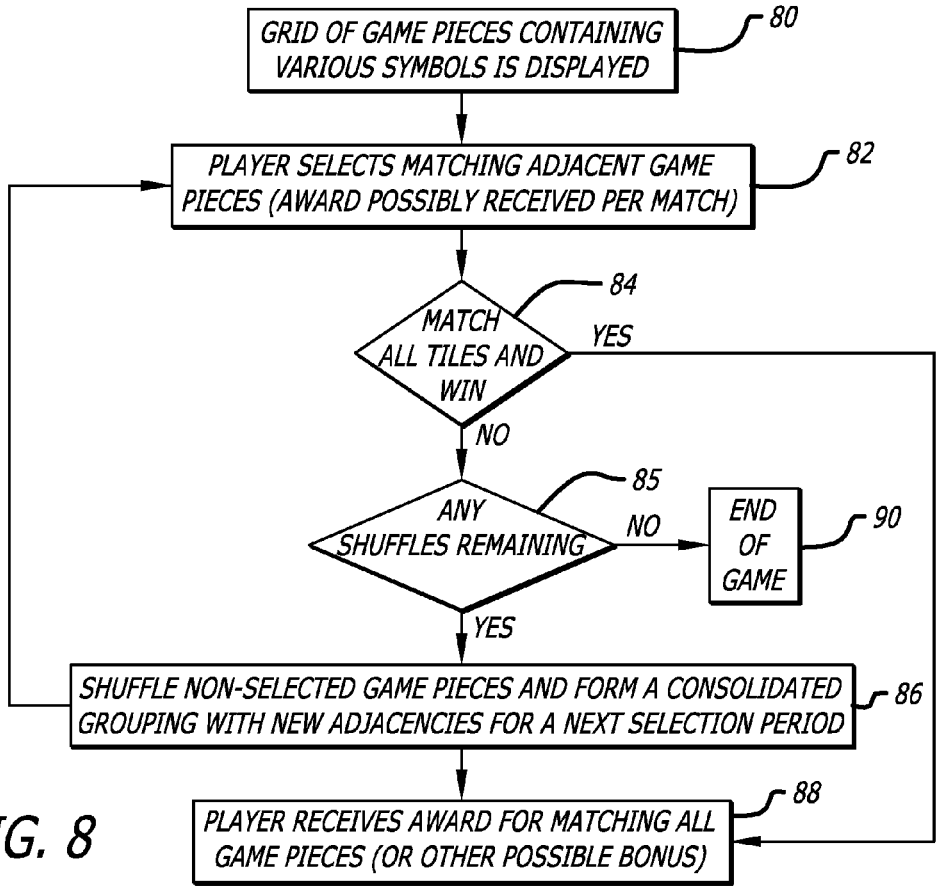
FIG. 8 is a flow chart of one embodiment, according to the present invention, showing the play of the matching game.
Figure 9:
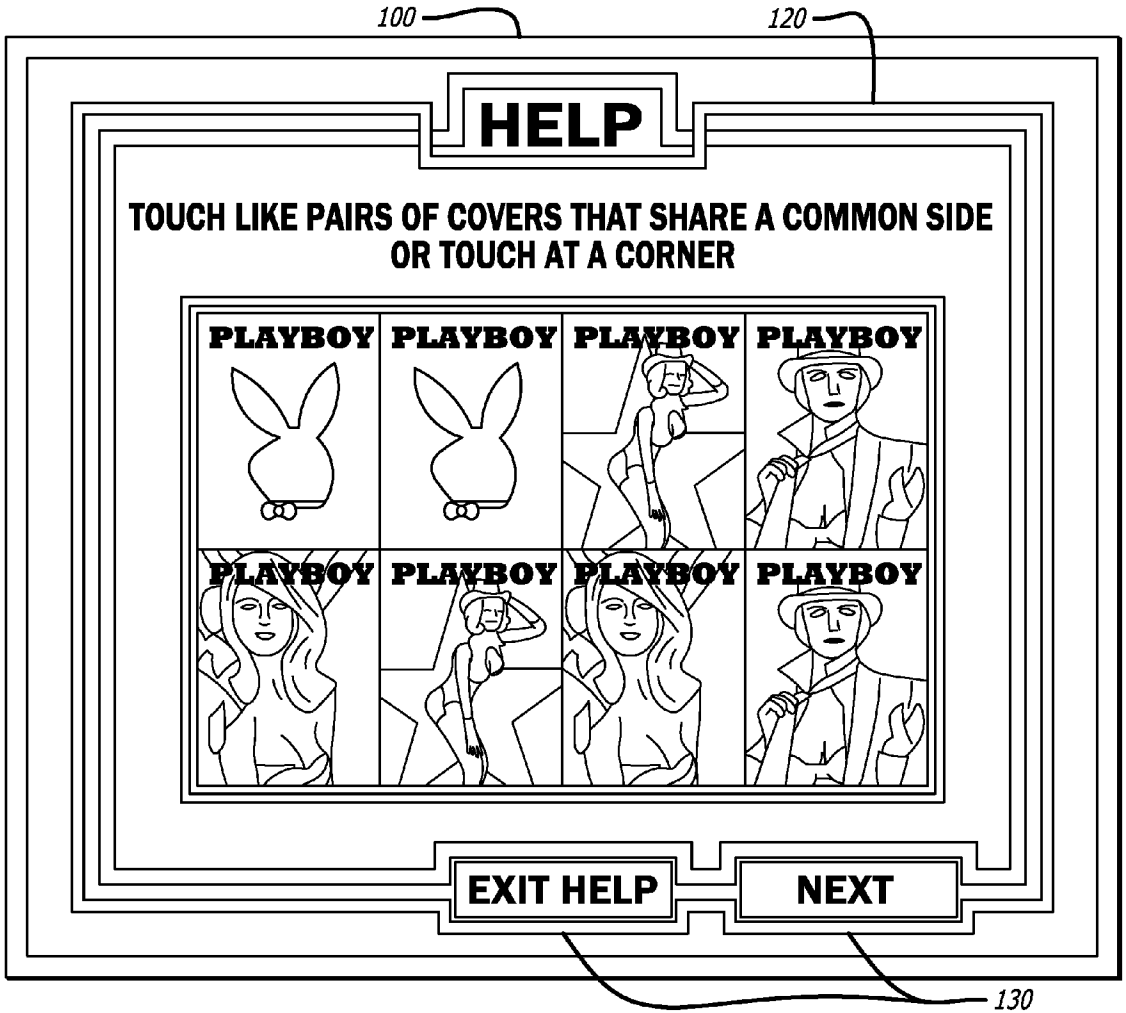
FIG. 9 is an initial exemplary screen of an interactive help feature that explains play of the matching game to a player, according to the present invention.
Figure 10:
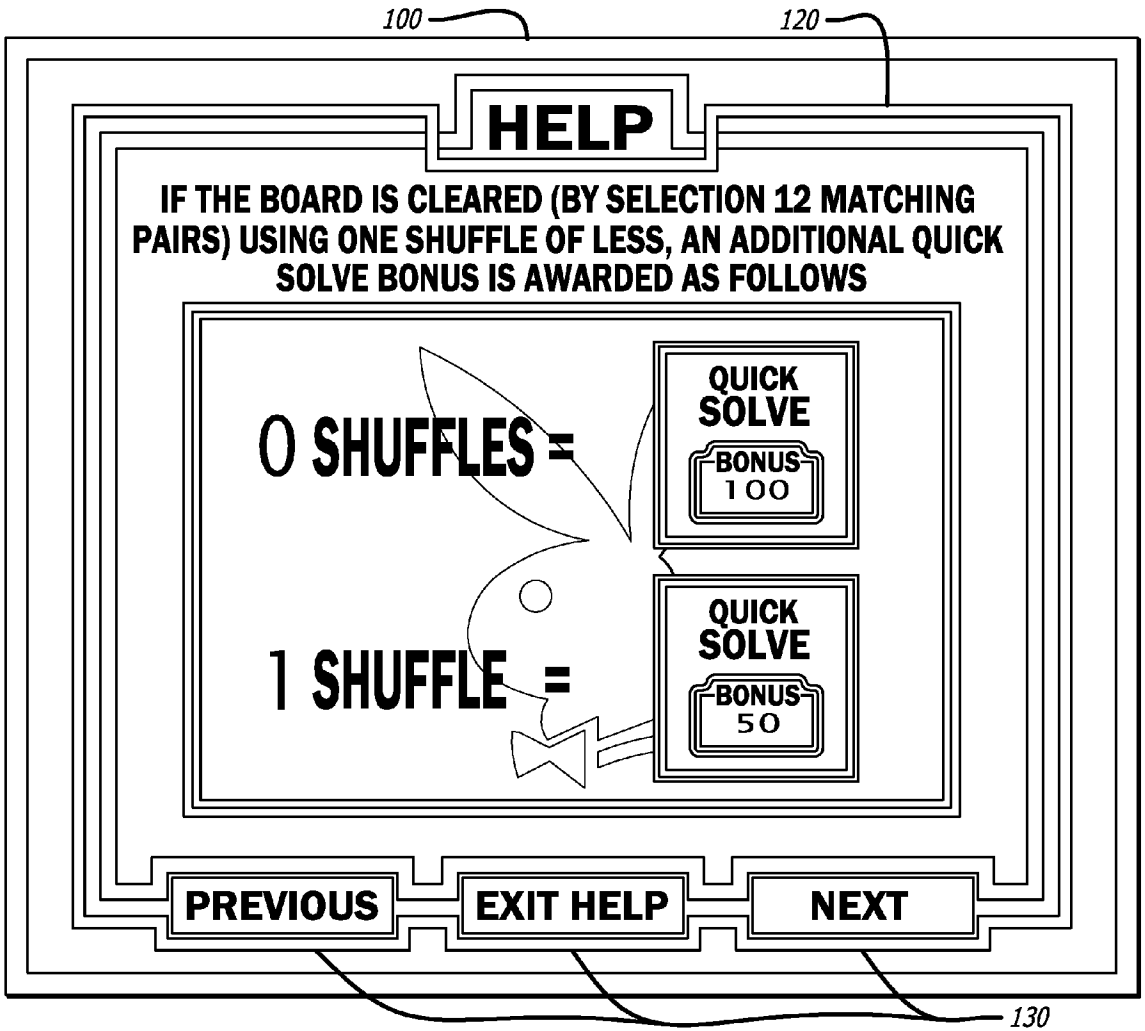
FIG. 10 is a second exemplary screen of an interactive help feature that explains play of the matching game to a player, according to the present invention.
Figure 11:
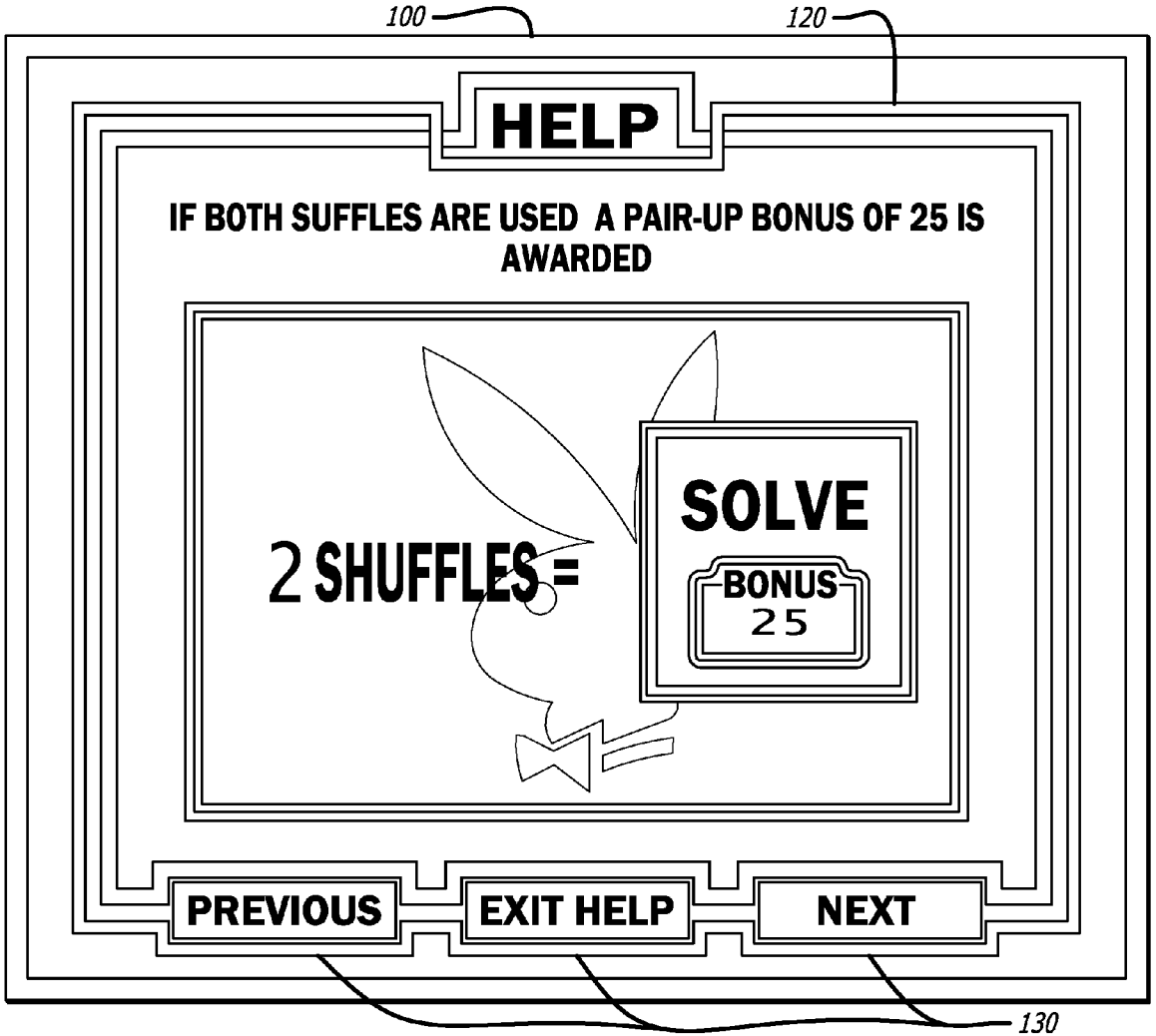
FIG. 11 is a third exemplary screen of an interactive help feature that explains play of the matching game to a player, according to the present invention.
Figure 12:
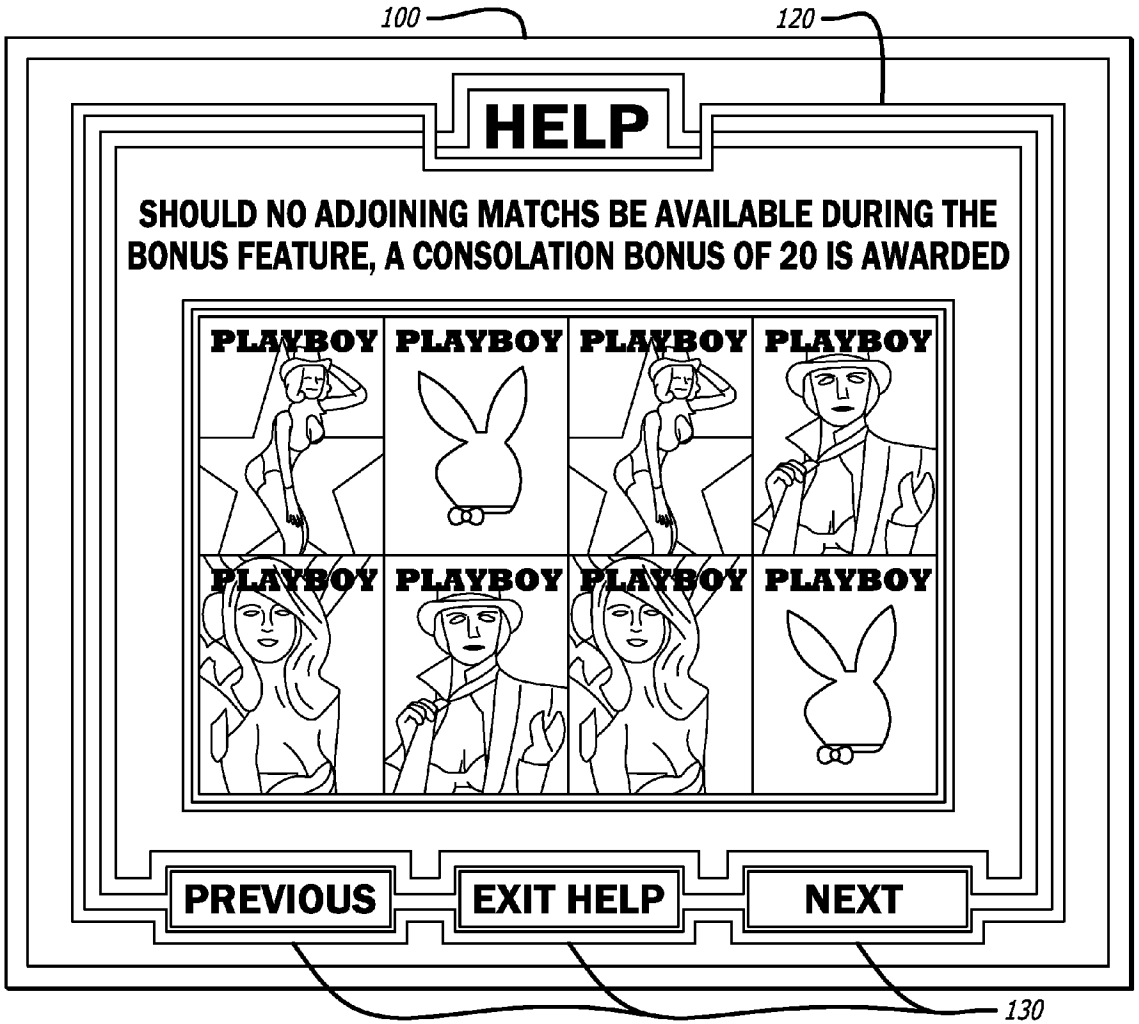
FIG. 12 is a fourth exemplary screen of an interactive help feature that explains play of the matching game to a player, according to the present invention.
Figure 13:
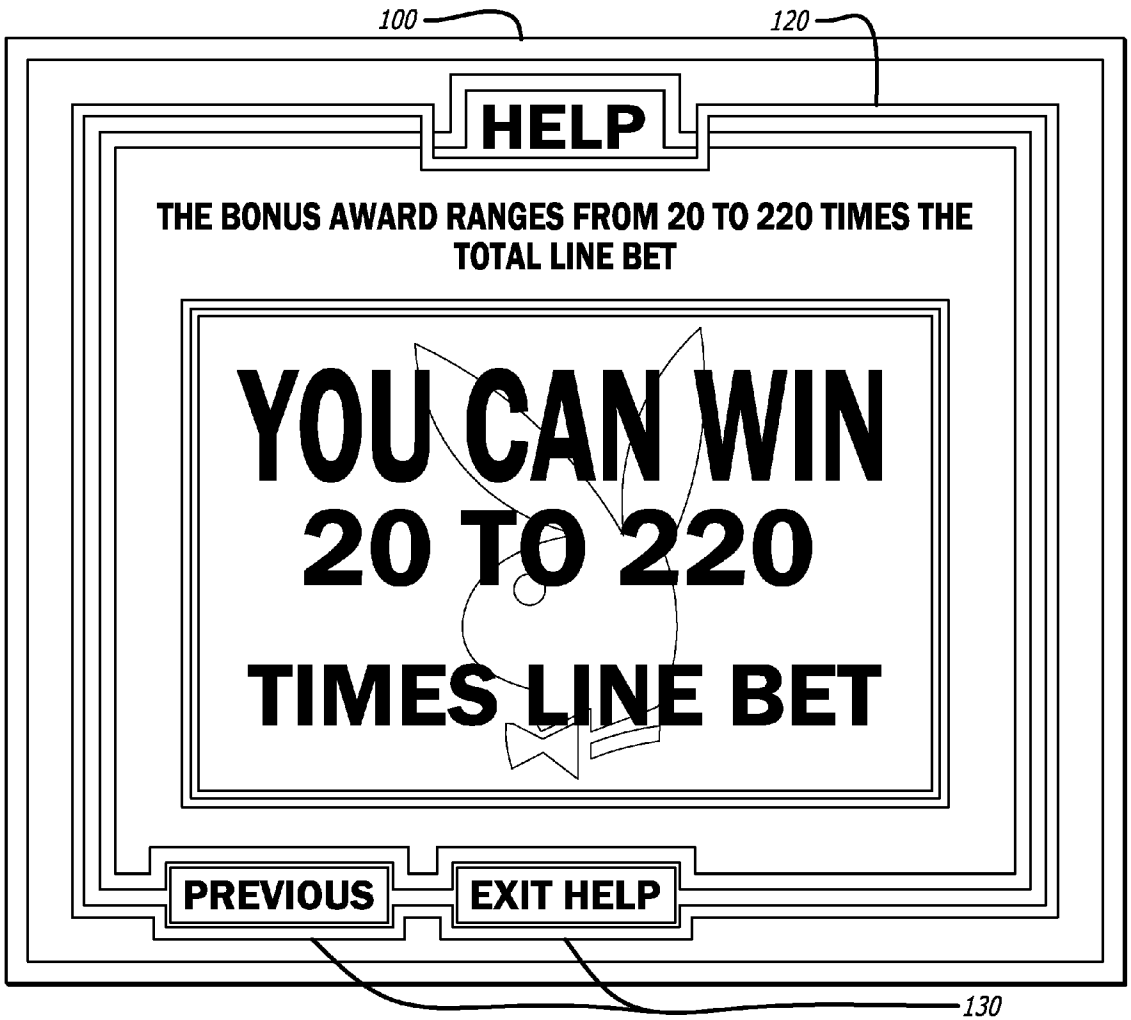
FIG. 13 is a fifth exemplary screen of an interactive help feature that explains play of the matching game to a player, according to the present invention.

Referring now to FIG. 8, a preferred method of playing the matching game includes displaying a grid 14 upon which indicia-bearing game pieces are positioned (Step 80). A player then selects matching adjacent game pieces 34 (Step 82). If the player succeeds in clearing all of the game pieces 12 in this first selection period, the player has won the game in the first period of play (Step 84) and an appropriate award and/or bonus is provided (Step 86).

However, if the player has matched, and thus cleared, fewer than all of the game pieces 12 in the first period of play, the player may then shuffle the game pieces that are not selected as matching adjacent game pieces during the first selection period. Thus, the player shuffles the non-selected game pieces 32 remaining from the first selection period to form a consolidated grouping of game pieces for a second selection period (Step 88). The player then selects any matching adjacent game pieces 34 during the second selection period (Back to Step 82). If the player successfully selects and clears all of the remaining game pieces 12, the player has won the game during the second selection period (Step 84), and an appropriate award and/or bonus is provided (Step 86).

If during the second period, however, the player fails to match and clear all of the remaining game pieces 12, the player may then shuffle the game pieces that are not selected as matching adjacent game pieces during the second selection period. By shuffling the non-selected game pieces 32 a second time after the second selection period, the player forms a consolidated grouping of game pieces for a third selection period (Step 88). The player then commences play during the third selection period by selecting any matching adjacent game pieces 34 from the latest consolidated grouping (Step 82). If the player successfully selects and clears all of the game pieces 12 during the third selection period, the player is provided with an appropriate award and/or bonus (Step 86). This process continues until there are no shuffles remaining (Step 85), and this represents the end of the game (Step 88). The player may also receive an award even if some game pieces 12 remain following the completion of the final selection period. This process is repeated for however many shuffles and selection periods as are provided in the particular embodiment of the present invention (Step 85).

In yet another embodiment of the matching game, merely selecting a matching adjacent pair of game pieces 12 reveals an award. That is, in this embodiment, matching two similar indicia 16 on two adjacent game pieces 12 results in an award to the player, regardless of, and independent of, whether the player actually selects and clears all of the rest of the game pieces from the grid 14. Furthermore, the value of the award for matching game pieces can be configured as a constant value or the award value can vary depending upon the play of the game and the end result.

A preferred embodiment of the matching game may also provide awards for which there is no monetary value. That is, the predetermined prize for winning the game is not the traditional monetary prize award. For example, in a preferred embodiment, the indicia 16 on the game pieces 12 on the grid 14 are pictures of Playboy Playmates. As with other embodiments described herein, the player selects matching adjacent game pieces 34 until either no more matches actually exist, or the player mistakenly believes that no more matches exist. The player may then shuffle the game pieces 12 in order to consolidate the remaining game pieces and to have an additional attempt to match all of the game pieces on the grid 14 with other matching adjacent game pieces. Preferably, if the player is successful in matching all of the game pieces 12 on the grid 14, an award is provided. In one preferred embodiment, the award is the display of a cover picture of the Playmate whose picture was on the final matched game pieces 12. Moreover, the award can encompass a combination of the traditional monetary award and a pictorial display. Although the pictures are described herein as Playboy Playmates, almost any type of pictorial display could be used. For example, sports legends, picturesque scenes, product advertisements, and the like could be used as the indicia 16 exhibited on the game pieces 12 of the grid 14.

The award may also be configured as one or more awards, including jackpots, bonuses, free games, and the like. In a preferred embodiment of the matching game, a special jackpot is provided if the player succeeds in clearing all of the game pieces 12 in the first selection period. That is, in order to win this special jackpot, the player must clear all of the game pieces 12 on the grid 14 without shuffling the game pieces and without going to a second or third selection period. This special jackpot could be a monetary award, free games, a pictorial display, or any other awards as desired by the gaming machine manufacturer. Likewise, tiered bonuses corresponding to the number of shuffles required to clear all of the game pieces may be provided. In this regard, as a player uses an increasing number of shuffles to attempt to clear all of the game pieces 12, the bonus, jackpot, or other award provided to the player will decrease.

A further embodiment provides bonuses and awards relating to the speed with which the player clears the game pieces 12 from the grid 14. By way of example, and not by way of limitation, if the player clears all of the game pieces 12 from the grid 14 in less than one minute, the player receives a certain award, whereas, if the player clears all of the game pieces from the grid in more than one minute, the player receives a lesser award. In other embodiments, other time parameters may be used. Similarly, tiered awards may also be configured relating to the speed with which the player selects all of the matching adjacent game pieces 34 for a given selection period (e.g., in the first selection period, the second selection period produced by the first shuffle, the third selection period produced by the second shuffle, and the like). In yet another embodiment, awards are based (at least in part) on player status. For example, in one such embodiment, a "VIP player" is awarded a special or different bonus award based upon their status and the play of the game.

In some embodiments, merely selecting a matching adjacent pair of game pieces 12 reveals an award. For example, if the player selects a pair of game pieces exhibiting monetary symbols, e.g. $100, by simply matching the two $100 game pieces, the player may be awarded $100. Similarly, if the player selects a pair of matching adjacent game pieces 34 that exhibit no ascertainable award value, the symbols on the game pieces may correspond to a predetermined prize that is awarded to the player upon the selection of the matching game piece indicia 16, i.e., a mystery jackpot. Further, the value of the award for matching game pieces 12 may be a constant value or the value of the award may vary. In each instance, matching two similar indicia 16 results in an award to the player, regardless of and independent of whether the player actually selects and clears the remainder of the game pieces 12 from the grid 14.

A preferred embodiment of the present invention provides for the strategy and skill of the player to affect the final outcome of the game. The indicia 16 exhibited on the game pieces 12 may correspond to a predetermined payout or other type of award (i.e., pictorial award). Furthermore, the last matched pair of game pieces may determine the amount of a monetary award or bonus or the pictorial award. Accordingly, the player may make strategy decisions designed to impact the selection of the final pair of game pieces. That is, if the player knows that matching a pair of clubs as the last pair will result in an award of $100, while matching a pair of hearts as the last pair will result in an award of $50, the player can make strategy decisions to affect the final outcome of the game, i.e., to have the final pair of game pieces matched as clubs instead of hearts.

Finally, in still another embodiment, the matching adjacent game pieces 34 that are selected do not disappear as two or more adjacent game pieces are matched. Instead, the player moves from game piece to game piece, selecting each game piece individually, until the player has matched one or more of the indicia categories of each game piece to those of any and all adjacent game pieces. Only when the player has selected all of the matching adjacent game pieces 34 and wishes to shuffle the game pieces for a subsequent selection period, do the matching adjacent game pieces 34 that were selected disappear (i.e., become blank grid positions) or become disabled from play. Thus, in this embodiment, once the player believes he has exhausted all potential matches in the grid, the player may shuffle the remaining, non-selected game pieces 32 and continue play as described above. Moreover, in this embodiment, the fact that the matching adjacent game pieces 34 remain on the grid 14 after being selected impacts the player's ability to make additional matches.

Referring now to FIGS. 1 and 9-13, another aspect of the present invention is directed towards a preferred embodiment gaming machine 10 that incorporates a primary game (e.g., a reel spinning game), a secondary game (e.g., the matching bonus game), and an interactive help feature 100 that provides information to assist a player in how to play a game while the game is actually in play. Preferably, the gaming machine 10 includes a video screen 17 that displays game play and a microprocessor 110 that controls at least a portion of the game play. In a preferred embodiment, the interactive help feature 100 provides game rules and related information for the secondary game, which in this embodiment, is the matching bonus game. In other embodiments, the interactive help feature 100 provides game rules and/or related information for the primary game in addition to and/or instead of the secondary game. In a preferred embodiment, the help feature is continuously accessible, allowing access to the help feature at any time during play of the game. Thus, if a player is unfamiliar with the play of the game, that player may receive instructions on how to play the game at any time that the help feature-assisted game is currently active.

In one embodiment, the interactive help feature 100 utilizes multiple help screens 120. Preferably, the interactive help feature 100 includes navigation controls 130 to assist a player in moving between the multiple help screens 120. However, in some embodiments, the interactive help feature 100 runs in an animated format when activated, and continues to do so, until the help feature is interacted with by the player. Preferably, the interactive help feature 100 includes both static and animated assets that provide explanations of game play; however, some embodiments include only static assets or animated assets. In one preferred embodiment, the animated assets in the interactive help feature 100 provide real time examples of game play. In other preferred embodiments, the animated assets are configured to allow a player to actually participate in at least a portion of a sample bonus game.

In a preferred embodiment of the present invention, the interactive help feature 100 incorporates touch screen controls. Preferably, the interactive help feature 100 can be exited by a player at any time using navigation controls or other player controls. In one preferred embodiment, the interactive help feature 100 occupies only part of the video screen 17, while in another preferred embodiment, the interactive help feature 100 occupies the entire video screen. In another aspect of a preferred embodiment, the interactive help feature 100 halts play of the bonus game while the interactive help feature 100 is activated. Alternatively, in another preferred embodiment, the interactive help feature 100 does not affect play of the bonus game when the interactive help feature 100 is activated. In some types of games, halting of the game play during the help feature 100 is necessary in order to prevent detrimental effects from occurring to the player while the help feature is being accessed; however, in other types of games, game play is not halted because halting the game play while the help feature 100 is activated gives the player an unfair advantage (e.g., more time to strategize, plan, and the like).

Another embodiment of the present invention is directed specifically towards an interactive help system for a video gaming machine 10. The interactive help system provides information that allows a player to learn game rules during play of an active game. In a preferred embodiment, the help system utilizes a video screen 17 that displays at least a portion of the help system when activated. A microprocessor 110 controls at least a portion of the help system. Specifically, the help system incorporates an interactive help feature 100 that is associated with the help feature-assisted game. Preferably, the help feature 100 is continuously accessible, allowing access to the help feature at any time during play of the game. In this manner, a player unfamiliar with the help feature-assisted game may receive instructions on how to play the game during an active help feature-assisted game. Thus, the help system 100 minimizes the chance that a player will be adversely affected during a game due to a lack of knowledge of the game's rules. The player can actually access the help system 100 and learn the game rules during an active game, instead of having to wait until after the game has terminated to access the interactive help feature.

Another preferred embodiment of the present invention is directed towards a method for playing a gaming machine 10 that incorporates an interactive bonus game help feature 100. The method includes initiating play of a primary game. Preferably in response to a predetermined outcome of the primary game, play of a bonus game is then initiated. The method further includes activating an interactive help feature 100 for the bonus game during play of the bonus game, preferably in response to a selection event by a player. In a preferred method, the interactive help feature 100 is available on demand by the player, and is initiatable at any time during play of the bonus game so that a player may receive instructions that assist in proper play of the bonus game while the bonus game is in active use. Preferably, the method also includes resuming play of the bonus game after the use of the help feature 100 is completed.

Furthermore, the various methodologies described above are provided by way of illustration only and should not be construed to limit the invention. Those skilled in the art will readily recognize various modifications and changes may be made to the present invention without departing from the true spirit and scope of the present invention. Accordingly, it is not intended that the invention be limited, except as by the appended claims.

What is claimed:

1. A game for a gaming machine comprising a microprocessor, a display and a set of player controls, the game comprising:

a primary game and a secondary game playable under control of the microprocessor;

a plurality of indicia-bearing game pieces displayed on the display in a gaming grid associated with the secondary game;

wherein the secondary game:

receives input from a player by way of the set of player controls, the input comprising selection of game pieces that are adjacent to one another and that have matching indicia and removes all of the selected matching adjacent game pieces from the gaming grid;

shuffles any remaining game pieces and presents a new grouping of the remaining game pieces, the shuffling causing the remaining game pieces to be in a new random order, and the new grouping of the remaining pieces being in the new random order; and repeats the selection and removal of any matching adjacent game pieces.

2. The game of claim 1, wherein the selection of game pieces that are adjacent and have matching indicia, and the removal of any matching adjacent game pieces that are selected, proceeds one pair of matching adjacent game pieces at a time.

3. The game of claim 1, wherein adjacent game pieces are defined as game pieces that touch along a vertical edge, a horizontal edge, or a diagonal corner.

4. The game of claim 1, wherein each game piece contains only a single indicium that is used to potentially match with the indicia displayed on adjacent game pieces.

5. The game of claim 1, wherein the indicium displayed on each game piece that is used to match with the indicia of adjacent game pieces corresponds to the prize to be awarded.

6. The game of claim 1, wherein the prize to be awarded is a non-monetary prize.

7. The game of claim 1, wherein the indicium displayed on each game piece includes a displayed magazine photograph.

8. The game of claim 1 wherein the indicium displayed on each game piece includes a displayed magazine cover.

9. The game of claim 1, wherein each game piece includes a plurality of indicia that are used to potentially match with at least one of the plurality of indicia of the adjacent game pieces.

10. The game of claim 1, wherein three indicia of the game pieces include game piece color, type of indicia and color of indicia.

11. The game of claim 1, wherein the player controls comprise a touch screen and wherein the game pieces are selected using the touch screen.

12. The gaming machine of claim 1 further comprising a video display, wherein the game pieces are video representations of game pieces.

* * * * *